US007662072B1

(12) United States Patent
Chen

(10) Patent No.: US 7,662,072 B1
(45) Date of Patent: Feb. 16, 2010

(54) HAND HOLDING TYPE EXERCISING DEVICE

(75) Inventor: Ming-Chin Chen, Changhua Hsien (TW)

(73) Assignee: Ever Gym Enterprises Co., Ltd., Changhua Hsien (TW)

( * ) Notice: Subject to any disclaimer, the term of this patent is extended or adjusted under 35 U.S.C. 154(b) by 0 days.

(21) Appl. No.: 12/370,812

(22) Filed: Feb. 13, 2009

(51) Int. Cl.
*A63B 21/02* (2006.01)

(52) U.S. Cl. ..... 482/81; 482/82

(58) Field of Classification Search ..... 482/81, 482/82, 91, 109, 110; 473/424, 256
See application file for complete search history.

(56) References Cited

U.S. PATENT DOCUMENTS 3,428,325 A * 2/1969 Atkinson ..... 473/256
5,054,772 A * 10/1991 Winston ..... 482/82
5,709,619 A * 1/1998 D'Emidio ..... 473/424
2004/0002408 A1* 1/2004 Rigas ..... 482/82
2009/0062084 A1* 3/2009 Gamboa et al. ..... 482/82

* cited by examiner

*Primary Examiner*—Jerome Donnelly
(74) *Attorney, Agent, or Firm*—Alan Kamrath; Kamrath & Associates PA

(57) ABSTRACT

An exercising device includes a control handle having a limit flange, a retaining ring mounted on the limit flange, a mounting seat combined with the retaining ring to limit the limit flange between the mounting seat and the retaining ring, a driven member mounted on the mounting seat, a stop member mounted on the driven member, and a weight member located between the mounting seat and the stop member. Thus, the weight member is adjustably mounted on the driven member to adjust the relative position between the weight member and the mounting seat and to adjust the damping force applied by the weight member onto a user's hand. In addition, the stop member can stop movement of the weight member to prevent the weight member from being detached from the driven member due to an excessive centrifugal force.

12 Claims, 6 Drawing Sheets

HAND HOLDING TYPE EXERCISING DEVICE

BACKGROUND OF THE INVENTION

1. Field of the Invention

The present invention relates to an exercising device and, more particularly, to an exercising device to provide exercising and playing functions to a user.

2. Description of the Related Art

A conventional exercising device in accordance with the prior art shown in FIG. 6 comprises a flexible cord 40 having a first end mounted on a control handle (not shown), and an inflatable ball 50 mounted on a second end of the flexible cord 40. The inflatable ball 50 has a side provided with a recess 51 to receive the second end of the flexible cord 40. In operation, when a user's hand holds and swings the control handle, the gravity of the inflatable ball 50 produces a centrifugal force to the control handle, so that the flexible cord 40 and the inflatable ball 50 are driven to revolve about the control handle reciprocally by the gravity of the inflatable ball 50 so as to achieve an amusing effect and an exercising function to the user.

However, the inflatable ball 50 is fixed on the second end of the flexible cord 40 so that the relative position between the inflatable ball 50 and the control handle is fixed and cannot adjusted, and the damping force applied by the inflatable ball 50 cannot be adjusted, thereby limiting the exercising effect of the exercising device. In addition, the inflatable ball 50 produces a greater centrifugal force to the flexible cord 40, so that the inflatable ball 50 is easily detached from the second end of the flexible cord 40 during a long-term utilization, thereby causing danger to the user.

BRIEF SUMMARY OF THE INVENTION

In accordance with the present invention, there is provided an exercising device, comprising a control handle having an end portion provided with an enlarged limit flange, a retaining ring mounted on the limit flange of the control handle, a mounting seat combined with the retaining ring and abutting the limit flange of the control handle to limit the limit flange of the control handle between the mounting seat and the retaining ring, a driven member mounted on the mounting seat, a stop member mounted on the driven member, and a weight member mounted on the driven member and located between the mounting seat and the stop member.

The primary objective of the present invention is to provide a hand holding type exercising device.

Another objective of the present invention is to provide an exercising device, wherein the weight member is adjustably mounted on the driven member to adjust the relative position between the weight member and the mounting seat so as to adjust the damping force applied by the weight member onto the user's hand according to the user's requirement so as to provide a comfortable sensation to the user.

A further objective of the present invention is to provide an exercising device, wherein the limit flange of the control handle is pivotable in the receiving space of the mounting seat and the mounting hole of the retaining ring so that the mounting seat is pivotable relative to the control handle during rotation of the driven member to expand the swinging movement of the driven member and to enhance the exercising effect to the user's hand.

A further objective of the present invention is to provide an exercising device, wherein the stop member can stop movement of the weight member to prevent the weight member from being detached from the driven member due to an excessive centrifugal force.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
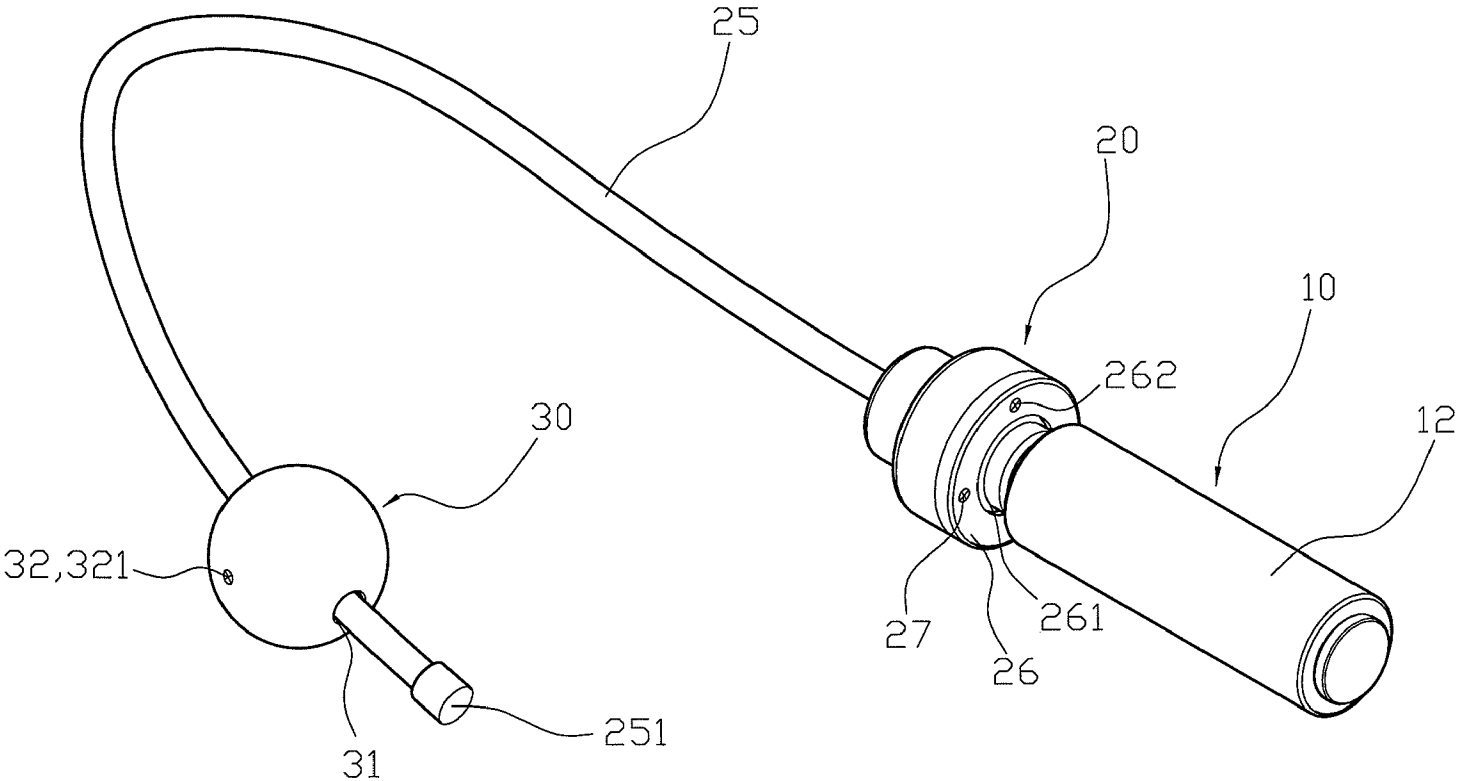
FIG. 1 is a perspective view of an exercising device in accordance with the preferred embodiment of the present invention.
Figure 2:
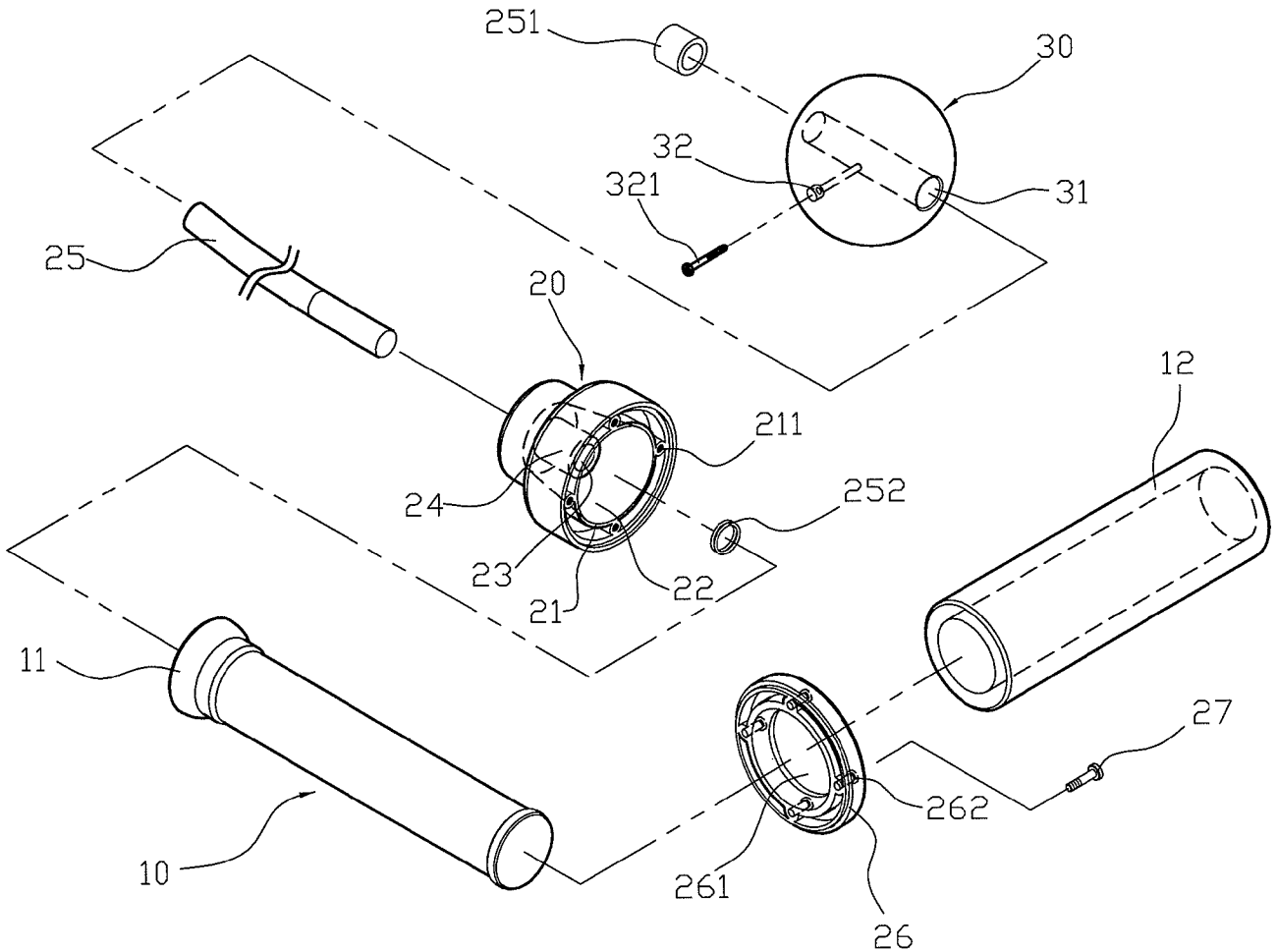
FIG. 2 is an exploded perspective view of the exercising device as shown in FIG. 1.
Figure 3:
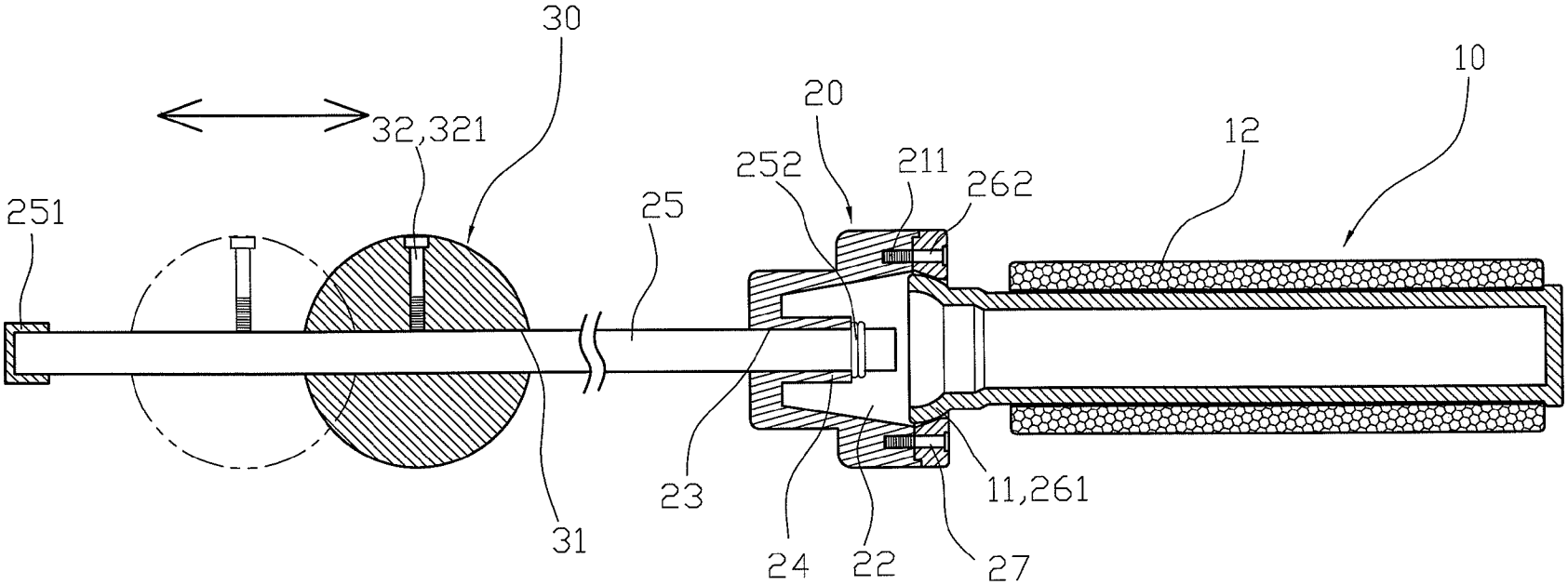
FIG. 3 is a front cross-sectional view of the exercising device as shown in FIG. 1.

Referring to the drawings and initially to FIGS. 1-3, an exercising device in accordance with the preferred embodiment of the present invention comprises a control handle 10 having an end portion provided with an enlarged limit flange 11, a soft grip 12 mounted on the control handle 10, a retaining ring 26 mounted on the limit flange 11 of the control handle 10, a mounting seat 20 combined with the retaining ring 26 and abutting the limit flange 11 of the control handle 10 to limit the limit flange 11 of the control handle 10 between the mounting seat 20 and the retaining ring 26, a driven member 25 mounted on the mounting seat 20, a stop member 251 mounted on the driven member 25, and a weight member 30 mounted on the driven member 25 and located between the mounting seat 20 and the stop member 251.

The control handle 10 is an elongate tube. The limit flange 11 of the control handle 10 has a substantially tapered shape. The retaining ring 26 is pivotally mounted on the limit flange 11 of the control handle 10 and has an inner portion provided with a mounting hole 261 pivotally mounted on the limit flange 11 of the control handle 10. The mounting hole 261 of the retaining ring 26 has a substantially tapered shape. The retaining ring 26 has a peripheral wall provided with a plurality of through holes 262 surrounding the mounting hole 261.

The mounting seat 20 has an inner portion provided with a receiving space 22 to receive the limit flange 11 of the control handle 10. The receiving space 22 of the mounting seat 20 has a substantially tapered shape. The receiving space 22 of the mounting seat 20 is pivotally mounted on the limit flange 11 of the control handle 10. The mounting seat 20 has an end portion provided with a protruding support tube 24 extending into the receiving space 22. The support tube 24 of the mounting seat 20 has an inner portion provided with a pivot hole 23 to allow passage of the driven member 25. The mounting seat 20 has a peripheral wall 21 provided with a plurality of screw bores 211 surrounding the receiving space 22.

The exercising device further comprises a plurality of locking bolts 27 each extending through a respective one of the through holes 262 of the retaining ring 26 and each screwed into a respective one of the screw bores 211 of the mounting seat 20 to combine the retaining ring 26 and the mounting seat 20 together.

The driven member 25 is an elongate flexible cord and has a first end mounted on the mounting seat 20. The first end of the driven member 25 extends through the pivot hole 23 of the support tube 24 and partially extends into the receiving space 22 of the mounting seat 20, and the exercising device further comprises a stop ring 252 secured on the first end of the driven member 25 and abutting the support tube 24 of the mounting seat 20 to prevent the first end of the driven member 25 from being detached from the support tube 24 of the mounting seat 20. The stop ring 252 is received in the receiving space 22 of the mounting seat 20. The stop member 251 is mounted on a second end of the driven member 25.

The weight member 30 has an inner portion provided with a through bore 31 to allow passage of the driven member 25. The weight member 30 has a periphery provided with a screw hole 32 connected to the through bore 31, and the exercising device further comprises a fastening bolt 321 screwed into the screw hole 32 of the weight member 30 and pressing the driven member 25 to fix the weight member 30 onto the driven member 25. The screw hole 32 of the weight member 30 is perpendicular to the through bore 31 of the weight member 30.

In assembly, the stop member 251 is mounted on the second end of the driven member 25, and the weight member 30 is mounted on the driven member 25. Then, the first end of the driven member 25 extends through the pivot hole 23 of the support tube 24 and partially extends into the receiving space 22 of the mounting seat 20. Then, the stop ring 252 is secured on the first end of the driven member 25 and abuts the support tube 24 of the mounting seat 20 to prevent the first end of the driven member 25 from being detached from the support tube 24 of the mounting seat 20. Then, the mounting hole 261 of the retaining ring 26 is mounted on the limit flange 11 of the control handle 10, and the retaining ring 26 is mounted on the mounting seat 20 to limit the limit flange 11 of the control handle 10 between the mounting seat 20 and the retaining ring 26. Then, each of the locking bolts 27 extends through a respective one of the through holes 262 of the retaining ring 26 and is screwed into a respective one of the screw bores 211 of the mounting seat 20 to combine the retaining ring 26 and the mounting seat 20 together. Finally, the soft grip 12 is mounted on the control handle 10.

As shown in FIG. 3, the weight member 30 is adjustably mounted on the driven member 25 to adjust a relative position between the weight member 30 and the mounting seat 20.

Figure 4:
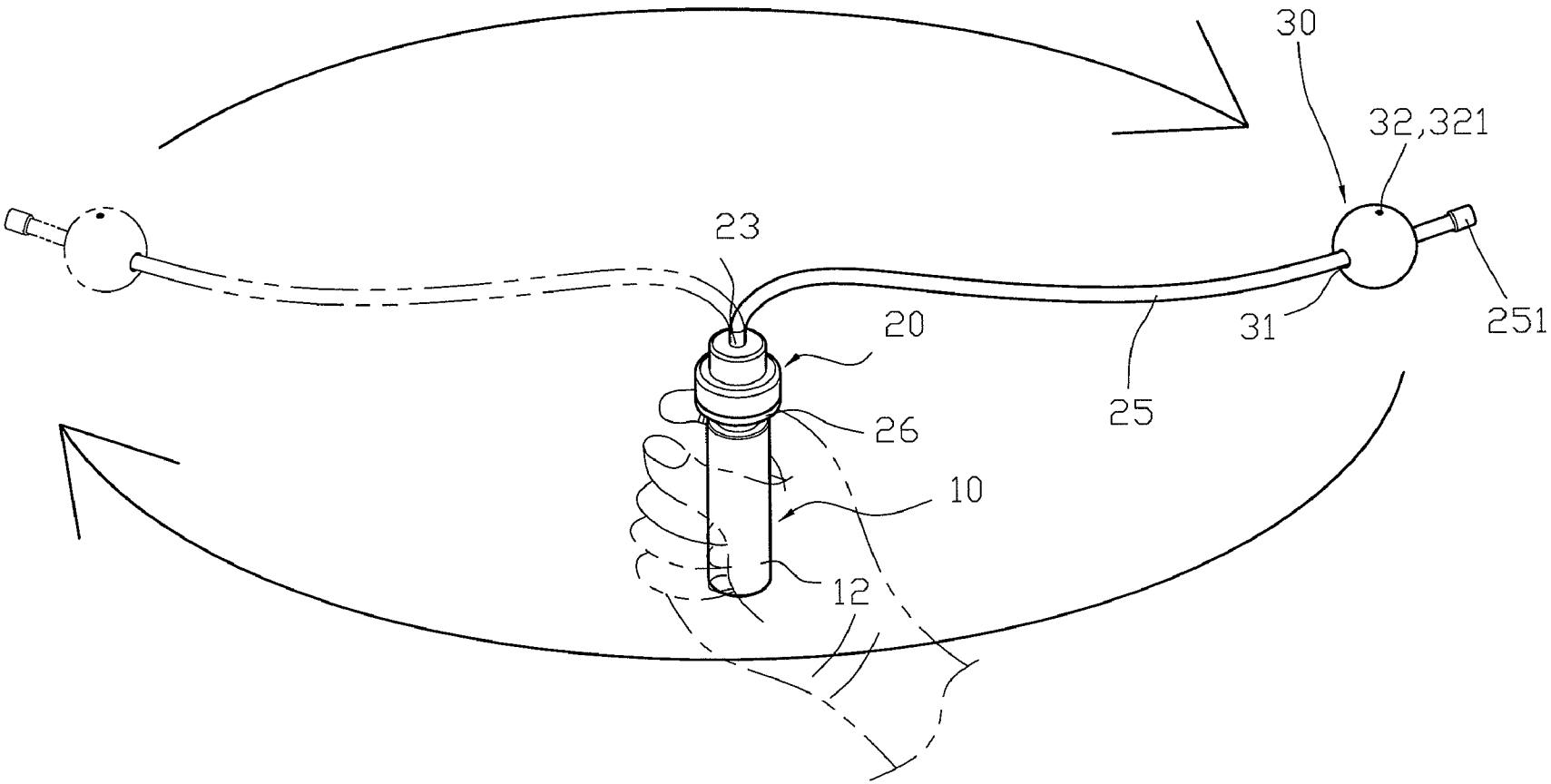
FIG. 4 is a schematic operational view of the exercising device as shown in FIG. 1.

In operation, referring to FIG. 4 with reference to FIGS. 1-3, when a user's hand holds and swings the control handle 10, the gravity of the weight member 30 produces a centrifugal force to the control handle 10, so that the driven member 25 and the weight member 30 are driven to revolve about the mounting seat 20 reciprocally by the gravity of the weight member 30 so as to achieve an amusing effect to the user. In addition, the user's hand has to exert a reaction force to overcome the centrifugal force produced by the gravity of the weight member 30 so as to exercise the user's hand. At this time, the weight member 30 is adjustably mounted on the driven member 25 to adjust the relative position between the weight member 30 and the mounting seat 20 so as to adjust the damping force applied by the weight member 30 onto the user's hand according to the user's requirement. In addition, when the weight member 30 is moved on the driven member 25 due to an excessive centrifugal force, the stop member 251 can stop movement of the weight member 30 to prevent the weight member 30 from being detached from the driven member 25 due to the excessive centrifugal force.

Figure 5:
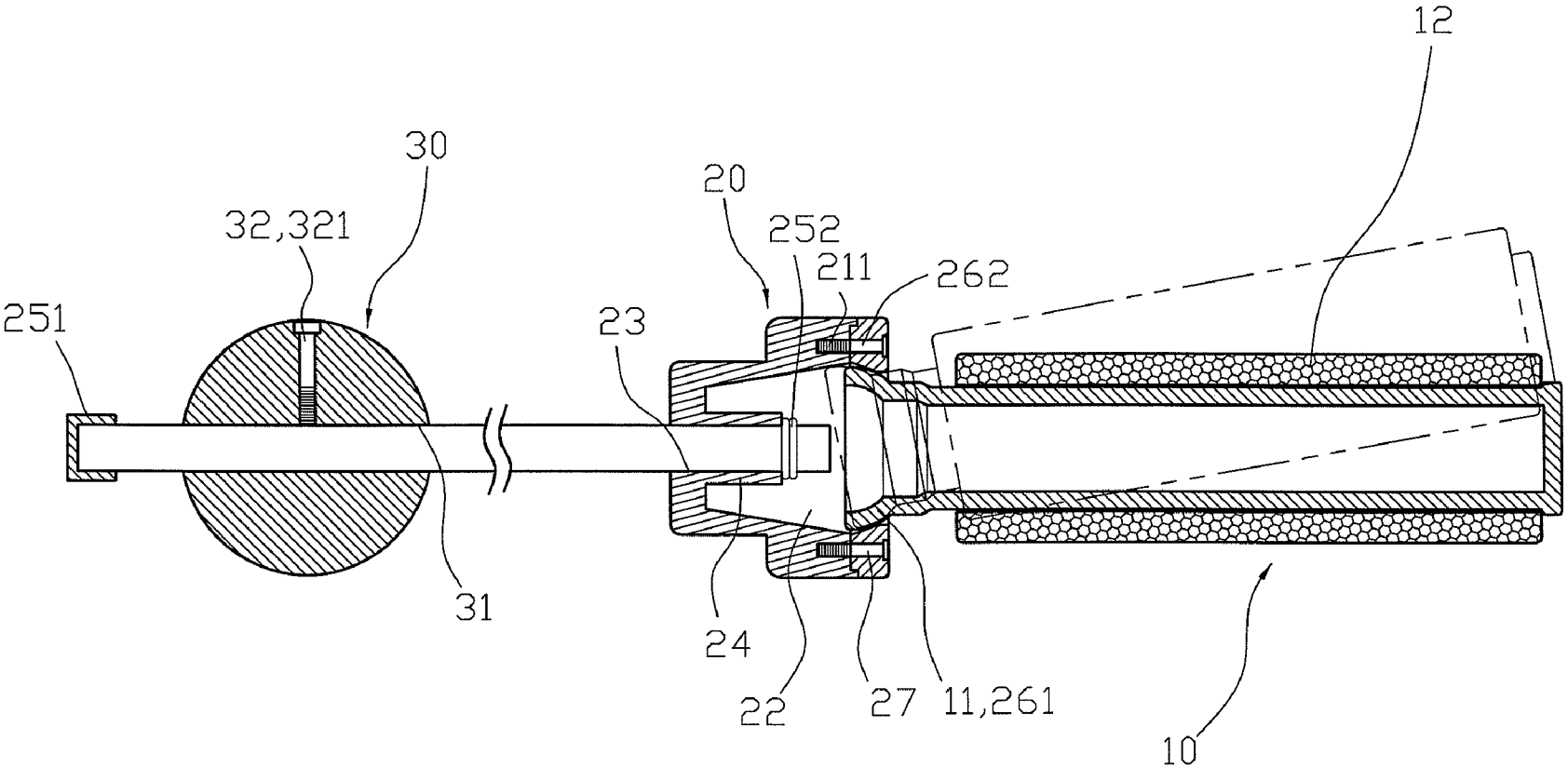
FIG. 5 is a schematic operational view of the exercising device as shown in FIG. 3.
Figure 6:
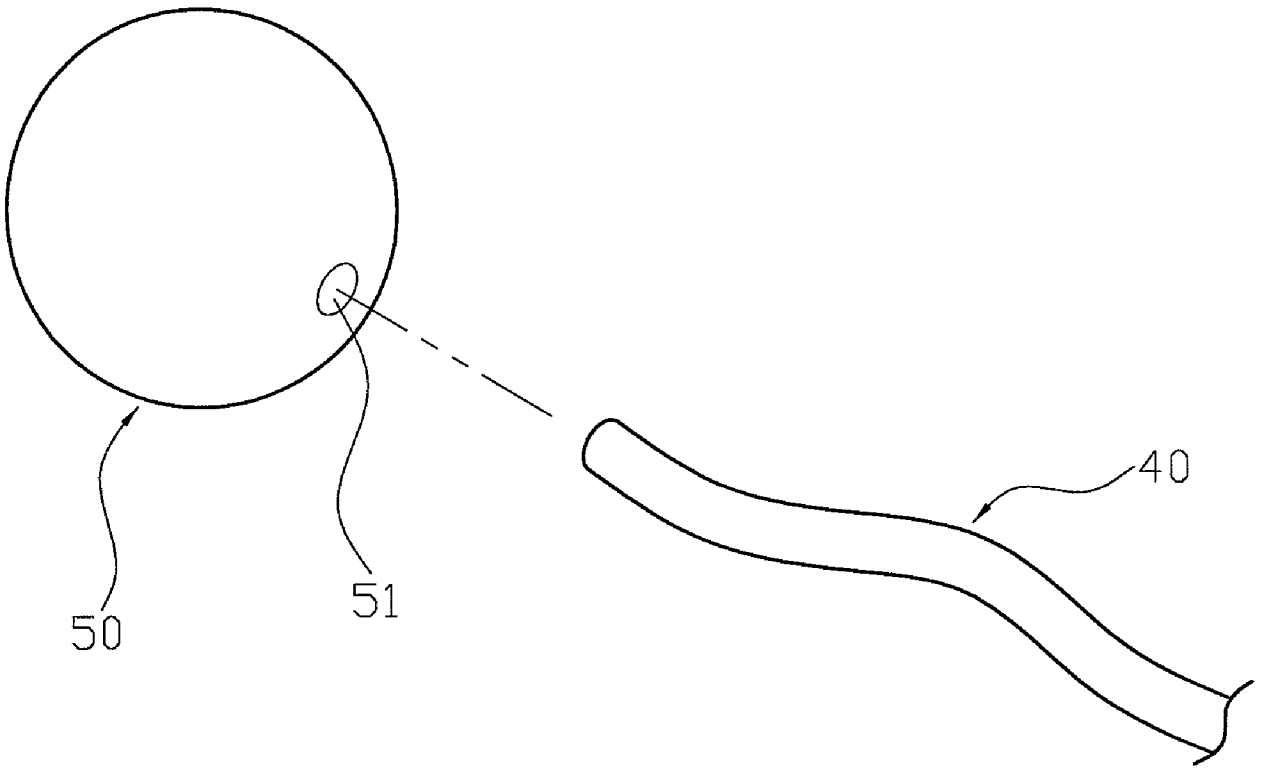
FIG. 6 PRIOR ART
FIG. 6 is an exploded perspective view of a conventional exercising device in accordance with the prior art.

As shown in FIG. 5, the limit flange 11 of the control handle 10 is pivotable in the receiving space 22 of the mounting seat 20 and the mounting hole 261 of the retaining ring 26 so that the mounting seat 20 and the retaining ring 26 are pivotable relative to the control handle 10 during rotation of the driven member 25 relative to the mounting seat 20 to facilitate movement of the driven member 25.

Accordingly, the weight member 30 is adjustably mounted on the driven member 25 to adjust the relative position between the weight member 30 and the mounting seat 20 so as to adjust the damping force applied by the weight member 30 onto the user's hand according to the user's requirement so as to provide a comfortable sensation to the user. In addition, the limit flange 11 of the control handle 10 is pivotable in the receiving space 22 of the mounting seat 20 and the mounting hole 261 of the retaining ring 26 so that the mounting seat 20 is pivotable relative to the control handle 10 during rotation of the driven member 25 to expand the swinging movement of the driven member 25 and to enhance the exercising effect to the user's hand. Further, the stop member 251 can stop movement of the weight member 30 to prevent the weight member 30 from being detached from the driven member 25 due to an excessive centrifugal force.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a control handle having an end portion provided with an enlarged limit flange;

a retaining ring mounted on the limit flange of the control handle;

a mounting seat combined with the retaining ring and abutting the limit flange of the control handle to limit the limit flange of the control handle between the mounting seat and the retaining ring;

a driven member mounted on the mounting seat;

a stop member mounted on the driven member;

a weight member mounted on the driven member and located between the mounting seat and the stop member;

wherein the retaining ring has an inner portion provided with a mounting hole pivotally mounted on the limit flange of the control handle;

the mounting seat has an inner portion provided with a receiving space to receive the limit flange of the control handle;

the retaining ring has a peripheral wall provided with a plurality of through holes surrounding the mounting hole;

the mounting seat has a peripheral wall provided with a plurality of screw bores surrounding the receiving space;

the exercising device further comprises a plurality of locking bolts each extending through a respective one of the through holes of the retaining ring and each screwed into a respective one of the screw bores of the mounting seat to combine the retaining ring and the mounting seat together;

the mounting seat has an end portion provided with a protruding support tube extending into the receiving space;

the support tube of the mounting seat has an inner portion provided with a pivot hole to allow passage of the driven member;

the driven member has a first end mounted on the mounting seat;

the exercising device further comprises a stop ring secured on the first end of the driven member and abutting the support tube of the mounting seat to prevent the first end of the driven member from being detached from the support tube of the mounting seat;

the weight member has an inner portion provided with a through bore to allow passage of the driven member;

the weight member has a periphery provided with a screw hole connected to the through bore;

the exercising device further comprises a fastening bolt screwed into the screw hole of the weight member and pressing the driven member to fix the weight member onto the driven member.

2. The exercising device of claim 1, wherein the receiving space of the mounting seat is pivotally mounted on the limit flange of the control handle.

3. The exercising device of claim 1, wherein the limit flange of the control handle has a substantially tapered shape;

the mounting hole of the retaining ring has a substantially tapered shape;

the receiving space of the mounting seat has a substantially tapered shape.

the mounting hole of the retaining ring has a substantially tapered shape.

4. The exercising device of claim 1, wherein the stop member is mounted on a second end of the driven member.

5. The exercising device of claim 1, wherein the first end of the driven member extends through the pivot hole of the support tube and partially extends into the receiving space of the mounting seat.

6. The exercising device of claim 1, wherein the screw hole of the weight member is perpendicular to the through bore of the weight member.

7. The exercising device of claim 1, further comprising a soft grip mounted on the control handle.

8. The exercising device of claim 1, wherein the limit flange of the control handle is pivotable in the receiving space of the mounting seat and the mounting hole of the retaining ring.

9. The exercising device of claim 1, wherein the mounting seat and the retaining ring are pivotable relative to the control handle during rotation of the driven member relative to the mounting seat.

10. The exercising device of claim 1, wherein the weight member is adjustably mounted on the driven member to adjust a relative position between the weight member and the mounting seat.

11. The exercising device of claim 1, wherein the control handle is an elongate tube.

12. The exercising device of claim 1, wherein the driven member is an elongate flexible cord.

* * * * *